US007980719B2

(12) United States Patent
Harris

(10) Patent No.: US 7,980,719 B2
(45) Date of Patent: Jul. 19, 2011

(54) DIGITAL LIGHT WITH TARGET EFFECTS

(75) Inventor: Jeremiah J. Harris, Las Vegas, CA (US)

(73) Assignee: Production Resource Group, L.L.C., New Windsor, NY (US)

( * ) Notice: Subject to any disclaimer, the term of this patent is extended or adjusted under 35 U.S.C. 154(b) by 625 days.

(21) Appl. No.: 11/681,731

(22) Filed: Mar. 2, 2007

(65) Prior Publication Data

US 2007/0221049 A1 Sep. 27, 2007

Related U.S. Application Data

(60) Provisional application No. 60/780,721, filed on Mar. 8, 2006.

(51) Int. Cl.
*F21V 9/16* (2006.01)

(52) U.S. Cl. ..... 362/103; 362/84; 362/105; 362/106; 362/107; 362/108; 340/555; 340/573.1

(58) Field of Classification Search ..... 362/103, 362/84, 105, 106, 107, 108; 434/22; 359/483, 359/465, 489, 501; 340/555, 573.1
See application file for complete search history.

(56) References Cited

U.S. PATENT DOCUMENTS

| | | | | |
|---|---|---|---|---|
| 1,654,370 | A * | 12/1927 | Goetschius | 40/542 |
| 3,549,878 | A * | 12/1970 | Bailey | 362/570 |
| 4,487,583 | A * | 12/1984 | Brucker et al. | 434/22 |
| 5,053,765 | A | 10/1991 | Sonehara et al. | |
| 5,774,174 | A | 6/1998 | Hardie | |
| 5,828,485 | A | 10/1998 | Hewlett | |
| 5,940,204 | A | 8/1999 | Hewlett | |
| 6,057,958 | A | 5/2000 | Hunt | |
| 6,188,933 | B1 | 2/2001 | Hewlett et al. | |
| 6,208,087 | B1 | 3/2001 | Hughes et al. | |
| 6,256,136 | B1 | 7/2001 | Hunt | |
| 6,267,482 | B1 * | 7/2001 | Miller et al. | 362/103 |
| 6,301,044 | B1 * | 10/2001 | Huber et al. | 359/483 |
| 6,538,797 | B1 | 3/2003 | Hunt | |
| 6,588,944 | B2 | 7/2003 | Harris | |
| 6,617,792 | B2 | 9/2003 | Hughes et al. | |
| 6,823,119 | B2 | 11/2004 | Harris | |
| 6,891,656 | B2 | 5/2005 | Hunt | |
| 7,052,154 | B2 * | 5/2006 | Vanderschuit | 362/105 |
| 2002/0181070 | A1 | 12/2002 | Hewlett | |
| 2005/0100289 | A1 | 5/2005 | Harris | |
| 2006/0177185 | A1 | 8/2006 | Harris | |
| 2006/0221597 | A1 * | 10/2006 | Hutchinson | 362/103 |

FOREIGN PATENT DOCUMENTS

DE 202005004255 * 12/2005

* cited by examiner

*Primary Examiner* — Sharon E Payne
(74) *Attorney, Agent, or Firm* — Law Office of Scott C. Harris, Inc.

(57) ABSTRACT

A digital light used with stage items. The digital light can form a portion of a stage performers costume, by for example illuminating a logo of the or a shape or color onto that costume. The digital light can also form effects when used in conjunction with phosphor paint. Another aspect includes using the digital light to signal the performer.

4 Claims, 1 Drawing Sheet

DIGITAL LIGHT WITH TARGET EFFECTS

CROSS-REFERENCE TO RELATED APPLICATIONS

This application claims priority to U.S. Provisional Application 60/780,721, filed Mar. 8, 2006. The disclosure of the prior applications are considered part of (and are incorporated by reference in) the disclosure of this application.

BACKGROUND

Digital lighting is described, for example, in U.S. Pat. No. 5,828,485. To summarize, digital lighting projects a beam to an object, where the beam is typically 200 to 900 watts of illumination, can produce any desired light output, where each element of the light forms a pixel of the displayed lighting effect. Therefore, a digital light can produce shaped outputs such as circles and stars, and can produce within those shaped output, any desired video scene or effect. Within the field of the digital lighting, any desired output effect can be controlled, limited only by the processing which is able to produce the digital lighting effect.

SUMMARY

The present application describes ways in which the digital light can be used to interface with its target.

DETAILED DESCRIPTION

Figure 1:
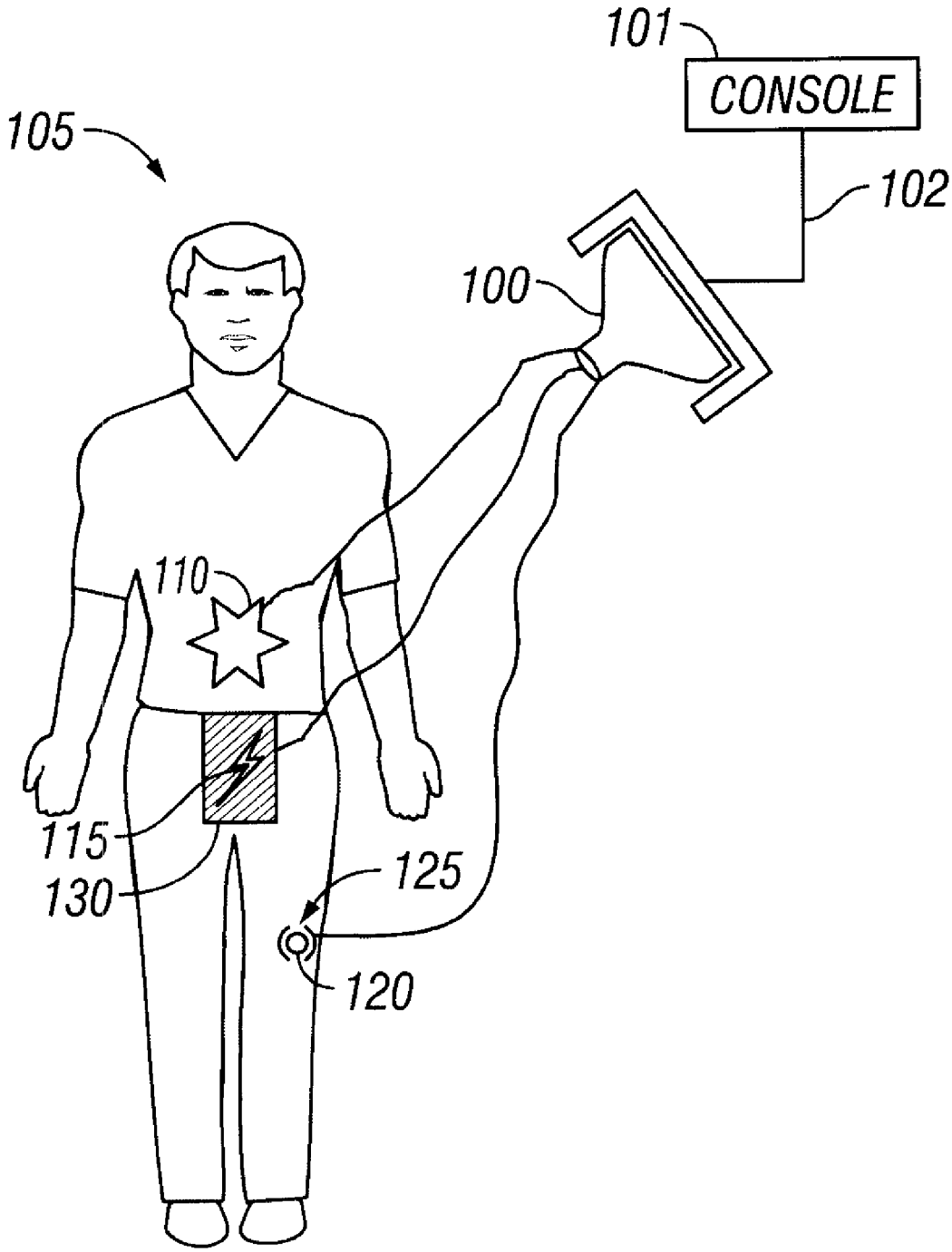
FIG. 1 shows an embodiment.

The general structure and techniques, and more specific embodiments which can be used to effect different ways of carrying out the more general goals, are described herein.

FIG. 1 shows a digital light, and the different kinds of things that can be produced in its field of optics. The light 100 is remotely electronically controlled, for example, over a control line 102 from a controlling console 101. The console may be remote from the light and operated by the operator who is supervising certain aspects of the shows. The light may be controlled by an operator who is watching the scene on the stage. The operator can control different effects produced.

The light can produce any desired effect. The light in FIG. 1 is shown as producing three separated shapes, a star shown as 110, a lightning bolt shown as 115, and a point shown as 120. These may be shown in any desired place. FIG. 1 shows these being shown on clothes or body parts of the performer, but it should be understood that this can also be shined on props such as scenery. The digital light can interact with different parts on the performer. For example, the star 110 can be a logo that is shining on the performer shirt. In this embodiment, the shirt is just a white T-shirt, and the star forms a logo that effectively forms part of the performer's costume. Therefore, the performer for example can become two different characters, one with the star, and the other where the star does not shine on the shirt at certain times. At other times, the star does shine on the shirt, thereby forming a logo on the shirt. The performer can be changed between the characters (in different costumes) at any desired time.

Of course, the effect can also change other parts, including shining on the performers face or head, to add color to the face, for example.

The second effect, the lightning bolt, shines on to a part of the performer has been modified using a paint 130 such as a phosphoric paint. By shining a lightning bolt on the phosphoric paint, the paint is caused to glow. The bolt for example can be turned on and off, while glow persists in the performer. According to another embodiment, the different shape of the paint on the performer effectively causes a different effect from the illumination.

A final illumination is the point of light 120 which may interact with a photoreceptor shown as 125, on the performer's costume. Therefore, the performer can be signaled in this way that they are supposed to do something, remotely. For example, the performer may have a photoreceptor hidden on their costume. When the controller for the operator at the controller detects that it is time for the performer to carry out some special operation, the digital light is used to illuminate the photo detector. A pencil like beam of light, for example one that is one half or ¼" in diameter can be used for this purpose. When the beam hits a photoreceptor 125, it may cause a buzzing sensation or other sensation that the performer 105 can feel. In this way, communication with the performer, using the digital light, is established.

Although only a few embodiments have been disclosed in detail above, other embodiments are possible and the inventor intends these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other techniques of using the digital light to communicate information to the performer.

The computers described herein may be any kind of computer, either general purpose, or some specific purpose computer such as a workstation. The computer may be a Pentium class computer, running Windows XP or Linux, or may be a Macintosh computer. The programs may be written in C, or Java, or any other programming language. The programs may be resident on a storage medium, e.g., magnetic or optical, e.g. the computer hard drive, a removable disk or other removable medium. The programs may also be run over a network, for example, with a server or other machine sending signals to the local machine, which allows the local machine to carry out the operations described herein.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

What is claimed is:

1. A method, comprising:

first remotely controlling a light for illuminating a performer at a first time without modifying a look of the performer's clothing;

second remotely controlling the light for illuminating the performer at a second time, where the illuminating at the second time comprises changing at least one look of the performer's clothing to a look different than controlled by said first remotely controlling, wherein the illuminating at a second time comprises projecting a shape of light onto the performer's clothing, and where said shape of light is a first shape at a first time, and a second wholly different shape at a second time at the same location on the performer's clothing; and based on a command to communicate to the performer, using said light to created a beam that is sent to a location on the performer's clothing separated from a location of said first shape and said second shape.

2. A method as in claim 1, wherein the illuminating at the second time comprises projecting a color onto the performer's clothing.

3. A method as in claim 1, further comprising at least one phosphor portion on the performer's clothing.

4. A method as in claim 1, wherein the illuminating at the second time comprises projecting a logo onto the performer's clothing.

* * * * *